US007028626B2

(12) United States Patent
Sakakibara

(10) Patent No.: US 7,028,626 B2
(45) Date of Patent: Apr. 18, 2006

(54) SEWING APPARATUS USING THREAD CASSETTE

(75) Inventor: Kaoru Sakakibara, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/606,735

(22) Filed: Jun. 27, 2003

(65) Prior Publication Data

US 2004/0000264 A1 Jan. 1, 2004

(30) Foreign Application Priority Data

Jun. 28, 2002 (JP) ..... 2002-189516

(51) Int. Cl.
*D05B 19/00* (2006.01)

(52) U.S. Cl. ..... 112/470.01; 112/278

(58) Field of Classification Search ..... 112/470.01, 112/270, 302, 254, 255, 275, 278, 453, 456, 112/458
See application file for complete search history.

(56) References Cited

U.S. PATENT DOCUMENTS

| | | | | |
|---|---|---|---|---|
| 3,749,039 | A | 7/1973 | Fritts | |
| 4,166,423 | A * | 9/1979 | Brienza et al. | 112/254 |
| 4,301,753 | A * | 11/1981 | Meier | 112/470.04 |
| 4,479,446 | A * | 10/1984 | Johnson et al. | 112/102.5 |
| 6,170,418 | B1 * | 1/2001 | Jaeger | 112/475.01 |
| 6,712,014 | B1 * | 3/2004 | Mamiya et al. | 112/2 |

FOREIGN PATENT DOCUMENTS

JP 2000-398263 12/2000

OTHER PUBLICATIONS

U.S. Appl. No. 10/451,734, filed Jun. 25, 2003, Kitazawa et al.

* cited by examiner

*Primary Examiner*—John J. Calvert
*Assistant Examiner*—Brian Kauffman
(74) *Attorney, Agent, or Firm*—Oliff & Berridge, PLC

(57) ABSTRACT

A sewing apparatus such as a sewing machine includes a sewing mechanism in which a needle thread is used, a cassette mount to which a thread cassette, while in a closed state, holding the needle thread used in the sewing mechanism is detachably attached, a determining unit determining a type of the thread cassette attached to the cassette mount, and a control device controlling the sewing mechanism according to the type of the thread cassette determined by the determining unit.

16 Claims, 15 Drawing Sheets

| SEWING CONDITION | STATUS |
|---|---|
| | A |
| NORMAL | 1 |
| EMBROIDERY | 0 |

FIG. 10

| MATERIAL | STATUS | | |
|---|---|---|---|
| | B | C | D |
| POLYESTER | 1 | 0 | 0 |
| COTTON | 0 | 0 | 0 |
| NYLON | 1 | 1 | 0 |
| SILK | 0 | 1 | 0 |
| RESILON | 1 | 0 | 1 |
| WAXING | 0 | 0 | 1 |
| - | 1 | 1 | 1 |
| - | 0 | 1 | 1 |

FIG. 11

| THREAD THICKNESS | STATUS | | |
|---|---|---|---|
| | E | F | G |
| #20 | 1 | 0 | 0 |
| #30 | 0 | 0 | 0 |
| #50 | 1 | 1 | 0 |
| #60 | 0 | 1 | 0 |
| #90 | 1 | 0 | 1 |
| - | 0 | 0 | 1 |
| - | 1 | 1 | 1 |
| - | 0 | 1 | 1 |

FIG.12

| THREAD LENGTH | STATUS |
|---|---|
| | H |
| 1000M | 1 |
| 300M | 0 |

FIG.13

| THREAD COLOR | STATUS | | | |
|---|---|---|---|---|
| | I | J | K | L |
| RED | 1 | 1 | 1 | 1 |
| PINK | 0 | 1 | 1 | 1 |
| ORANGE | 1 | 0 | 1 | 1 |
| BROWN | 0 | 0 | 1 | 1 |
| YELLOW | 1 | 1 | 0 | 1 |
| GREEN | 0 | 1 | 0 | 1 |
| BLUE | 1 | 0 | 0 | 1 |
| PURPLE | 0 | 0 | 0 | 1 |
| BLACK | 1 | 1 | 1 | 0 |
| WHITE | 0 | 1 | 1 | 0 |
| DARK BLUE | 1 | 0 | 1 | 0 |
| SKY BLUE | 0 | 0 | 1 | 0 |
| GRAY | 1 | 1 | 0 | 0 |
| BEIGE | 0 | 1 | 0 | 0 |
| - | 1 | 0 | 0 | 0 |
| - | 0 | 0 | 0 | 0 |

FIG. 14

| THREAD COLOR | COLORED THREAD CODE | STATUS | | | | | | | | | | |
|---|---|---|---|---|---|---|---|---|---|---|---|---|
| | | B | C | D | E | F | G | H | I | J | K | L |
| ORDINARY BLACK | 900 | 0 | 1 | 1 | 1 | 0 | 0 | 0 | 0 | 1 | 0 | 0 |
| DARK BLACK | 100 | 0 | 0 | 0 | 0 | 1 | 1 | 0 | 0 | 1 | 0 | 0 |
| ORDINARY WHITE | 1 | 0 | 0 | 0 | 0 | 0 | 0 | 0 | 0 | 0 | 0 | 1 |
| DARK WHITE | 2 | 0 | 0 | 0 | 0 | 0 | 0 | 0 | 0 | 0 | 1 | 0 |
| ORDINARY RED | 800 | 0 | 1 | 1 | 0 | 0 | 1 | 0 | 0 | 0 | 0 | 0 |
| DARK RED | 149 | 0 | 0 | 0 | 1 | 0 | 0 | 1 | 0 | 1 | 0 | 1 |
| ORDINARY PINK | 85 | 0 | 0 | 0 | 0 | 1 | 0 | 1 | 0 | 1 | 0 | 1 |
| DARK PINK | 155 | 0 | 0 | 0 | 1 | 0 | 0 | 1 | 1 | 0 | 1 | 1 |
| ORDINARY DEEP PINK | 86 | 0 | 0 | 0 | 0 | 1 | 0 | 1 | 0 | 1 | 1 | 0 |
| DARK DEEP PINK | 24 | 0 | 0 | 0 | 0 | 0 | 0 | 1 | 1 | 0 | 0 | 0 |
| ORDINARY ROSE | 124 | 0 | 0 | 0 | 0 | 1 | 1 | 1 | 1 | 1 | 0 | 0 |
| DARK ROSE | 152 | 0 | 0 | 0 | 1 | 0 | 0 | 1 | 1 | 0 | 0 | 0 |
| ORDINARY MAGENTA | 107 | 0 | 0 | 0 | 0 | 1 | 1 | 0 | 1 | 0 | 1 | 1 |
| DARK MAGENTA | 126 | 0 | 0 | 0 | 0 | 1 | 1 | 1 | 1 | 1 | 1 | 0 |
| ORDINARY VERMILION | 30 | 0 | 0 | 0 | 0 | 0 | 0 | 1 | 1 | 1 | 1 | 0 |
| DARK VERMILION | 148 | 0 | 0 | 0 | 1 | 0 | 0 | 1 | 0 | 1 | 0 | 0 |
| ORDINARY CRIMSON | 807 | 0 | 0 | 1 | 0 | 0 | 1 | 0 | 0 | 1 | 1 | 1 |
| DARK CRIMSON | 158 | 0 | 0 | 0 | 1 | 0 | 0 | 1 | 1 | 1 | 1 | 0 |
| ORDINARY DEEP PURPLISH RED | 869 | 0 | 0 | 1 | 0 | 1 | 1 | 0 | 0 | 1 | 0 | 1 |
| DARK DEEP PURPLISH RED | 636 | 0 | 0 | 0 | 0 | 1 | 1 | 1 | 1 | 1 | 0 | 0 |
| ORDINARY PURPLISH RED | 620 | 0 | 0 | 0 | 0 | 1 | 1 | 0 | 1 | 1 | 0 | 0 |
| DARK PURPLISH RED | 625 | 0 | 0 | 0 | 0 | 1 | 1 | 1 | 0 | 0 | 0 | 1 |
| ORDINARY SALMON PINK | 79 | 0 | 0 | 0 | 0 | 1 | 0 | 0 | 1 | 1 | 1 | 1 |
| DARK SALMON PINK | 122 | 0 | 0 | 0 | 0 | 1 | 1 | 1 | 1 | 0 | 1 | 0 |
| ⋮ | ⋮ | ⋮ | ⋮ | ⋮ | ⋮ | ⋮ | ⋮ | ⋮ | ⋮ | ⋮ | ⋮ | ⋮ |

FIG.15

SEWING APPARATUS USING THREAD CASSETTE

BACKGROUND OF THE INVENTION

1. Field of the Invention

This invention relates to a sewing apparatus to which a thread held by a thread cassette is supplied so that a sewing operation is carried out.

2. Description of the Related Art

In conventional sewing apparatus such as sewing machines, a thread cassette holding a needle thread in a wound state is attached to a cassette mount provided in a body of the apparatus, as disclosed in U.S. Pat. No. 3,749,039 to Russell A. Fritts. When possessing a large number of thread cassettes, a user needs to grasp characteristic including a material, length and usage of the thread held in each thread cassette. The user manually sets sewing conditions (thread tension, sewing speed, etc.) suitable for each thread in view of the characteristics of each thread when sewing is carried out using each thread.

However, when a beginner, who may be unfamiliar with the material and the characteristics of the thread held in each thread cassette, uses a sewing apparatus, he or she sometimes cannot confirm a thread held in the thread cassette easily in case that a printed indication of thread material and the like have disappeared or the thread is not exposed from the thread cassette. In such a case, there is a possibility that sewing conditions suitable for the thread held in the thread cassette may not be set. Furthermore, setting sewing conditions suitable for the threads held in the respective thread cassettes is troublesome for users familiar with the sewing machines.

SUMMARY OF THE INVENTION

Therefore, an object of the present invention is to provide a sewing apparatus in which the user can carry out sewing suitable for a type of thread held in the thread cassette, such a thread cassette and a control program for such a sewing apparatus.

The present invention provides a sewing apparatus comprising a sewing mechanism in which a needle thread is used, a cassette mount to which a thread cassette, while in a closed state, holding the needle thread used in the sewing mechanism is detachably attached, a determining unit determining a type of the thread cassette attached to the cassette mount, and a control device controlling the sewing mechanism according to the type of the thread cassette determined by the determining unit.

In the above-described sewing apparatus, the sewing mechanism is automatically controlled according to the type of the thread cassette determined by the determining unit. Consequently, the user can carry out a suitable sewing operation without a troublesome work such as setting sewing conditions and accordingly, the convenience of the sewing apparatus can be improved.

The invention also provides a sewing apparatus comprising a sewing mechanism in which a thread is used, an informing unit informing of the sewing mechanism, a cassette mount to which a thread cassette holding the thread used in the sewing mechanism is detachably attached, a determining unit determining a type of the thread cassette attached to the cassette mount, and a control device controlling the informing unit according to the type of the thread cassette determined by the determining unit.

When the thread cassette is attached to the cassette mount, information according to the type of the thread cassette is automatically informed. Consequently, the user can carry out the sewing operation according to the informed content and accordingly, the convenience of the sewing apparatus can be improved.

The thread cassette holding a thread supplied to a sewing mechanism of a sewing apparatus comprises a determination portion which allows the determining unit to determine a type of a thread held when the thread cassette is attached to the sewing apparatus.

Furthermore, the sewing apparatus is controlled by a computer. The computer is operated according to a control program on which the sewing mechanism is controlled according to the type of the thread determined by the determining unit.

BRIEF DESCRIPTION OF THE DRAWINGS

Other objects, features and advantages of the present invention will become clear upon reviewing the following description of embodiment, made with reference to the accompanying drawings, in which:

FIG. 10 shows a relation between the state of a limit switch A and the corresponding sewing condition;

FIG. 11 shows a relation between the states of limit switches B to D and the corresponding thread material in the normal stitch;

FIG. 12 shows a relation between the states of limit switches E to G and the corresponding thread diameter in the normal stitch;

FIG. 13 shows a relation between the state of limit switch H and the corresponding thread length in the normal stitch;

FIG. 14 shows a relation between the states of limit switches I to L and the corresponding thread color in the normal stitch;

FIG. 15 shows a relation between the states of limit switches B to L and the corresponding thread color in the embroidering;

DETAILED DESCRIPTION OF THE INVENTION

Figure 1:
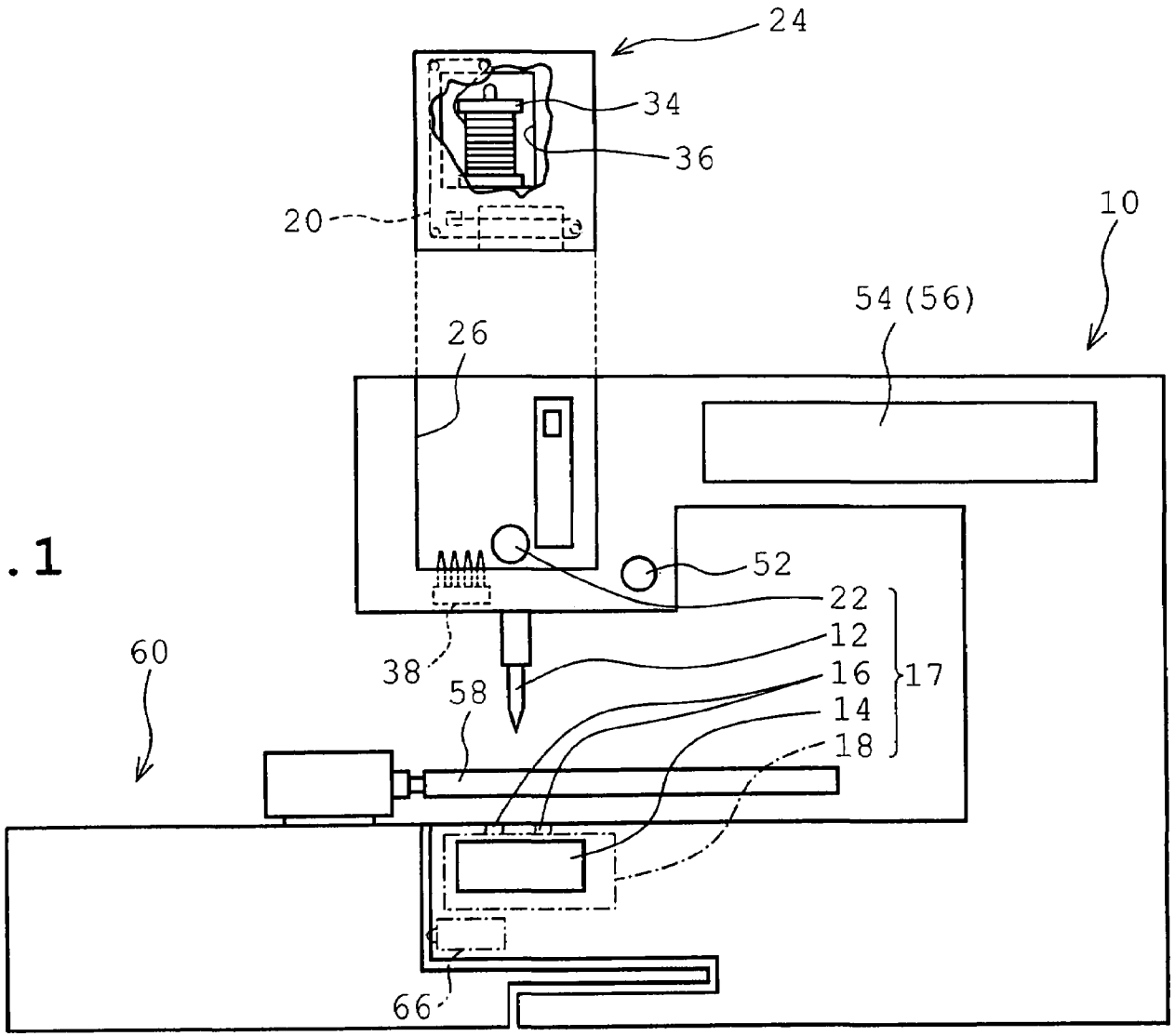
FIG. 1 is a schematic front view of a sewing machine and a thread cassette of one embodiment in accordance with the present invention.

One embodiment of the present invention will be described with reference to the accompanying drawings. Referring to FIGS. 1 to 5, a sewing machine 10 serving as a sewing apparatus comprises a sewing mechanism 17 including a needle 12 moved up and down, a shuttle 14 rotated in synchronization with the movement of the needle 12, a feed dog mechanism 18 having a feed dog 16 moving a cloth forward and backward in synchronization with the movement of the needle 12, and a thread tensioning mechanism 22 adjusting a thread tension of a needle thread 20 passed through a needle hole (not shown) of the needle 12, as shown in Japanese Patent Application No. 2000-398263 filed by the assignee of the present application. The sewing machine 10 further includes a cassette mount 26 to which a thread cassette 24 holding the needle thread 20 is detachably attached. The cassette mount 26 is provided for temporarily fixedly disposing the thread cassette 24 at a predetermined position relative to the sewing mechanism 17.

A needle swinging pulse motor 28 is provided for automatically swinging the needle 14 in the right-and-left direction according to a sewing mode automatically selected or selected by the user. The needle swinging pulse motor 28 serves as a needle swinging unit. The feed dog mechanism 18 serving as a feeder includes a feed amount pulse motor 30 for automatically changing a movement amount of cloth by the feed dog 16 according to a selected sewing mode or a set movement value of cloth. The thread tensioning mechanism 22 serving as an adjuster includes a thread tension pulse motor 32 for automatically adjusting a thread tension of the needle thread 20 according to a selected sewing mode or a set thread tension value. The thread tension pulse motor 32 of the thread tensioning mechanism 22 changes pressure applied to the needle thread 20 located between two thread tension discs (not shown) so that the thread tension discs hold the needle thread 20 located between the thread cassette 24 attached to the cassette mount 26 and the needle 12. The aforesaid motors 28, 30 and 32 constitute the sewing mechanism 17.

The closed type thread cassette 24 has an accommodating cavity 36 for accommodating a thread spool 34 on which the needle thread 20 is wound. The substantially overall thread spool 34 accommodated in the cavity 36 is surrounded by walls. In order that the combination of the thread cassette 24 and the thread spool 34 may not be changed with ease, the thread spool 34 cannot easily be taken out of the accommodating cavity 36 without breaking a part of the thread cassette 24. Furthermore, the needle thread 20 is deteriorated (for example, crocked) when exposed to sunbeams. In view of this, the walls of the thread cassette 24 are opaque. Accordingly, the user cannot easily view the needle thread 20 wound on the thread spool 34 accommodated in the accommodating cavity 36 of the thread cassette 24.

Before attaching the thread cassette 24 to the sewing machine 10, the user needs to draw the needle thread 20 out and extend it along a centrally formed guide groove (not shown) in the right-and-left direction over the periphery of the thread cassette. Subsequently, when the thread cassette 24 is attached to the accommodating cavity 26, a part of the needle thread 20 located on the center of the thread cassette 24 is held between the discs of the thread tensioning mechanism 22.

As a characteristic construction of the sewing machine 10, a limit switch group 38 (see FIG. 3) composed of twelve limit switches A to L is provided near a lowermost horizontal wall of the accommodating cavity 26. The limit switches A to L have respective detecting sections serving as determining members and projecting through vertical through holes formed in the horizontal wall of the accommodating cavity 26, toward a movement path of the thread cassette 20. The detecting sections are adapted to be depressed by a flat face of a determination portion 40 provided on the underside (bottom plate) of the thread cassette 24.

The determination portions of the thread cassette 24 are positioned over the limit switch group 38 when the thread cassette is attached to the cassette mount 26. The flat face of the determination portion 40 is formed with depressions A' to L' (see FIG. 4) depressed inward (upward). Each depression has an opening at the underside of the thread cassette 24 and is formed into the shape of a generally circular cylinder or cone. Each depression has a larger diameter than each detecting section and an amount of depression larger than an amount of projection of the detecting section of each limit switch from the horizontal face of the cassette mount 26.

The detecting sections of the limit switches A to L are brought into contact with the face of the determination portion 40 when the thread cassette 24 is positioned lowermost in the cassette mount 26, whereupon the contacted limit switches are turned to the ON state. Furthermore, when the determination portion 40 is formed with the depressions A' to L', the detecting sections of the limit switches A to L enter the respective depressions even when the thread cassette 24 is positioned lowermost in the cassette mount 26. Consequently, the limit switches A to L having entered the depressions are maintained in the OFF state.

Figure 4:
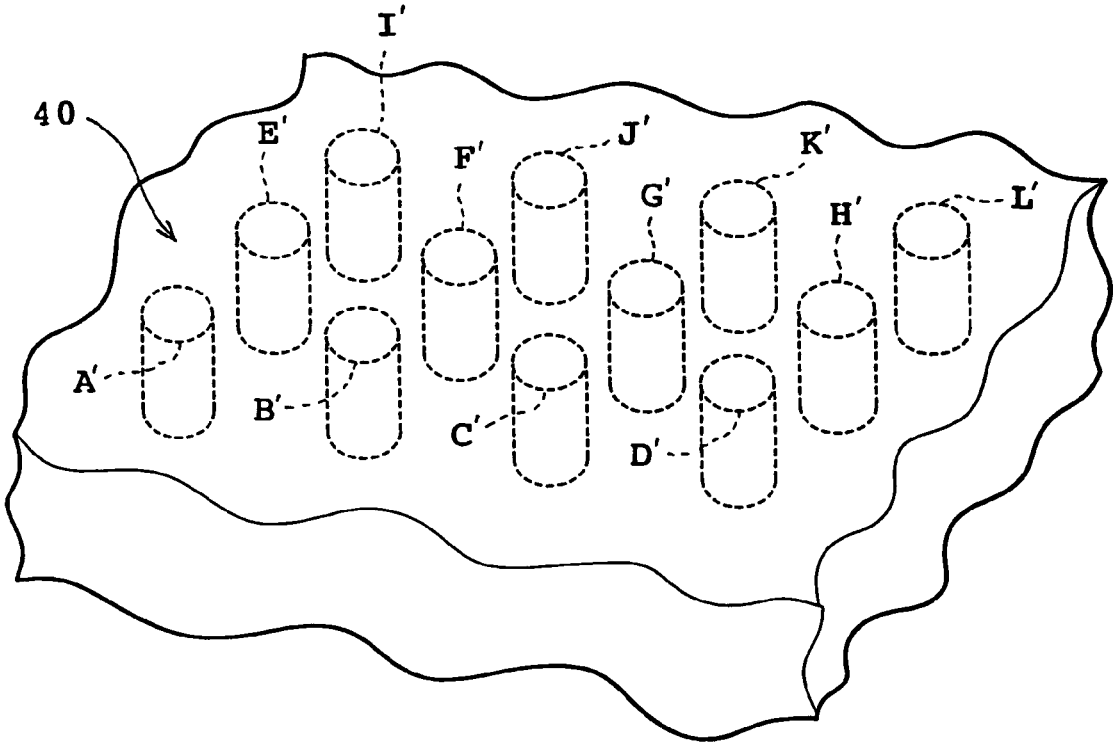
FIG. 4 is an enlarged perspective view of a determined portion of the thread cassette.
Figure 5:
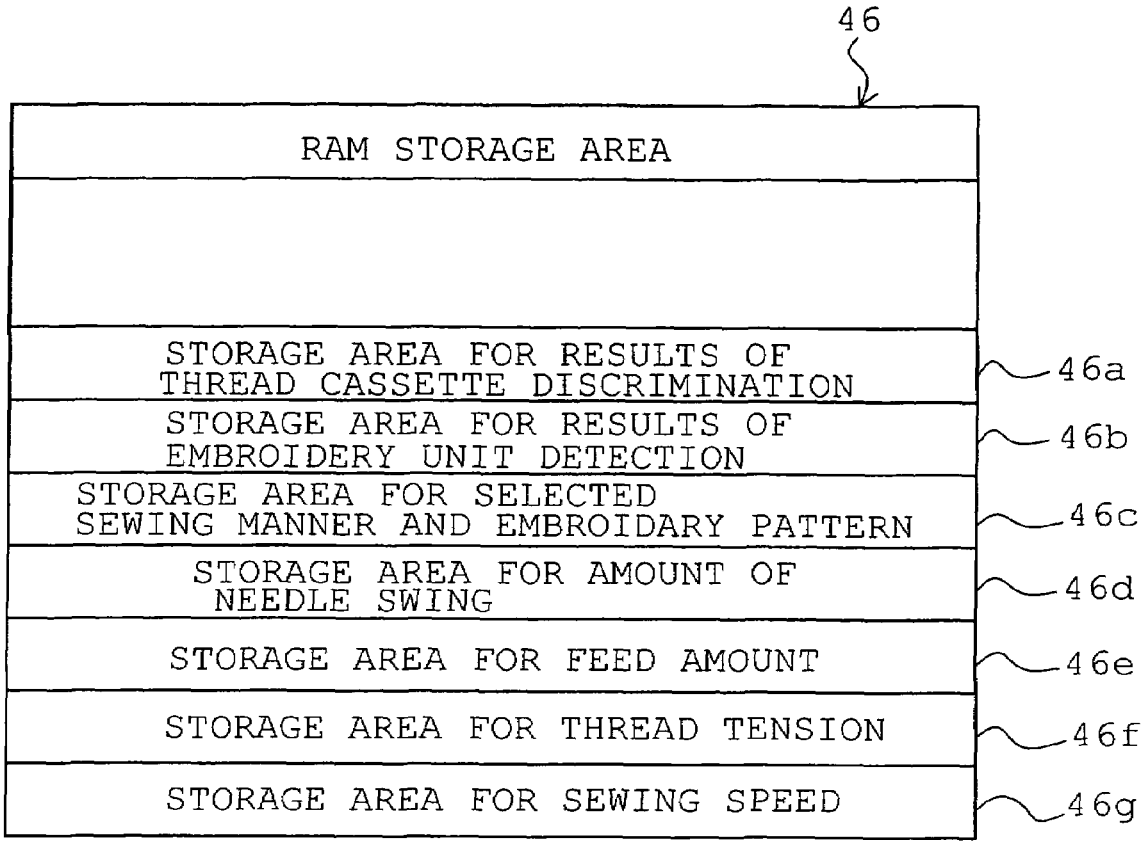
FIG. 5 shows a storage area of RAM.
Figure 6:
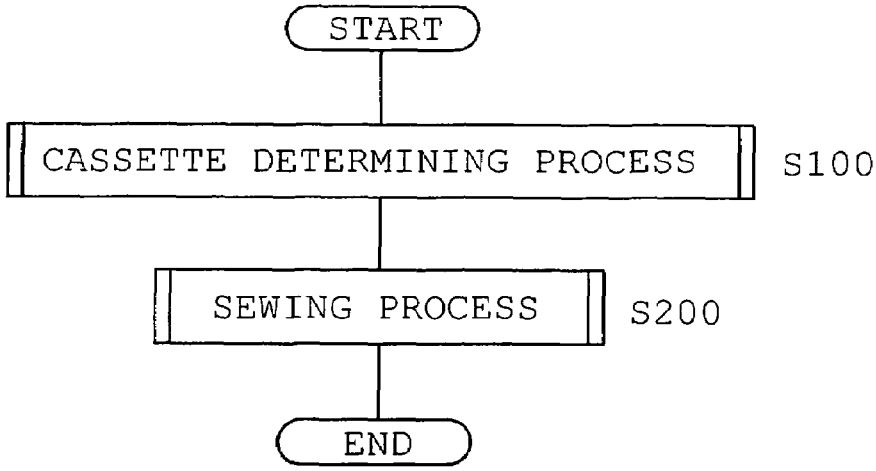
FIG. 6 is a flowchart showing control of the overall sewing machine.

The depressions A' to L' are formed at positions shown by broken line in FIG. 4 so as to correspond to the respective limit switches A to L. The number and positions of the depressions A' to L' are determined for every type of the thread cassette 24 or the needle thread 20 held on the thread cassette. As a result, the limit switch group 38 operates in a different on/off mode according to the depressions A' to L'. In the embodiment, no thread cassette 24 has twelve depressions A' to L' and accordingly, there is no case where all the limit switches A to L are in the OFF state.

Figure 2:
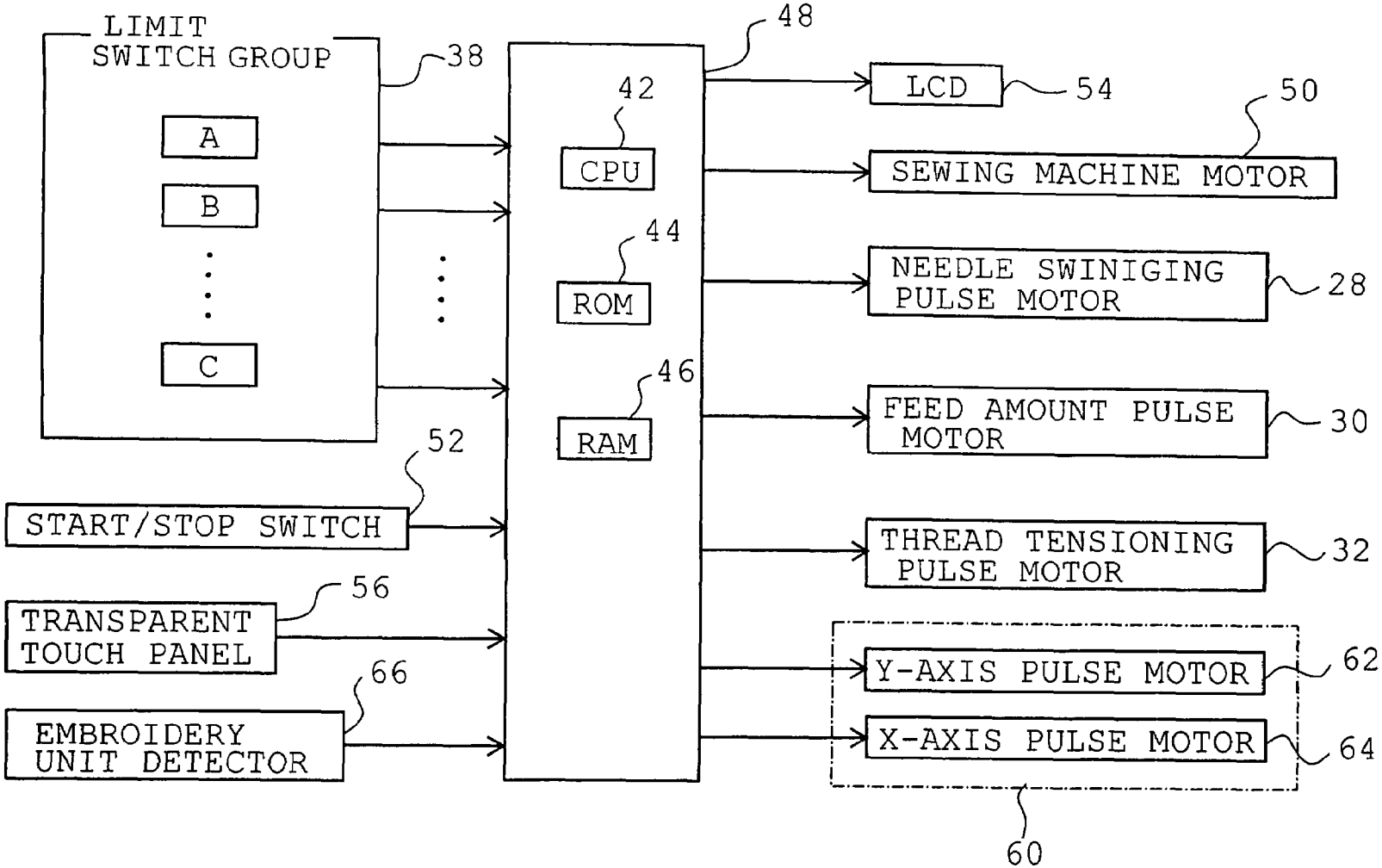
FIG. 2 is a block diagram showing an electrical arrangement of the sewing machine.
Figure 3:
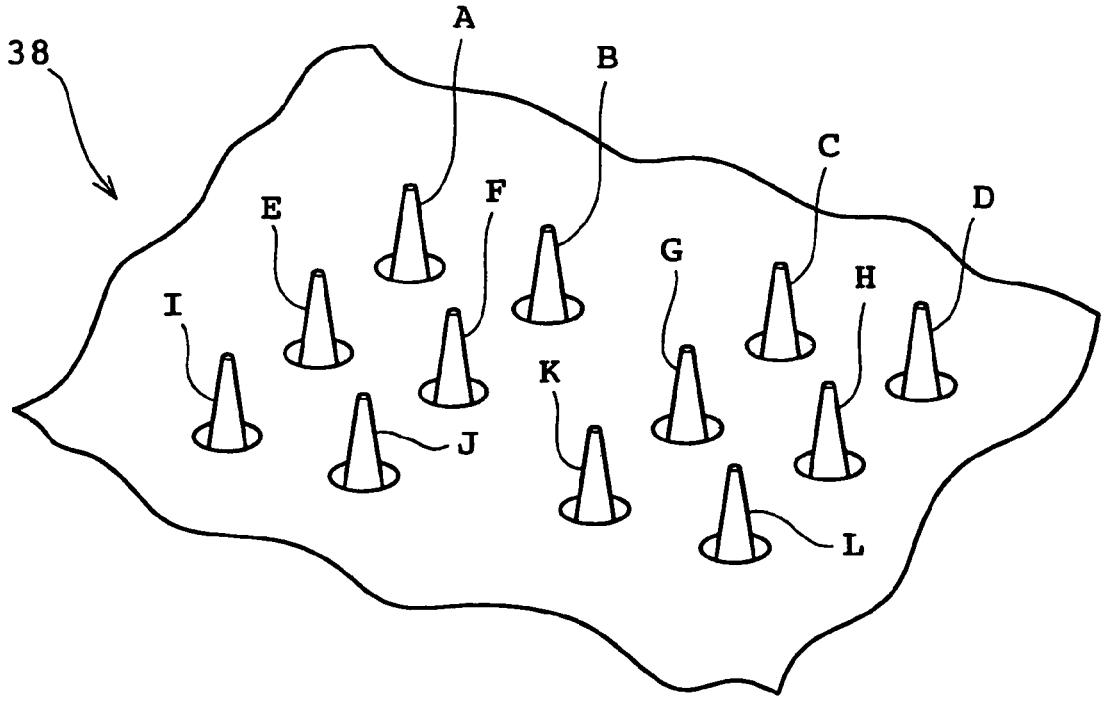
FIG. 3 is an enlarged perspective view of limit switches.

A control device 48 comprises CPU 42, ROM 44 and RAM 46 as shown in FIG. 2. The control device 48 determines the on/off state of each limit switch of the limit switch group 38 constantly or suitably. A determination program, control program and data program are previously stored in ROM 44. On the determination program, the control device 48 determines the thread cassette 24 attached to the cassette mount 26 on the basis of the on/off state of the limit switch group 38. The controlled device operating on the determination program and the limit switch group 38 constitute a determining unit in the invention.

On the control program, the control device 48 controls the sewing mechanism 17 according to the on/off state of the limit switch group 38 and a selected sewing mode. The data table is necessary for the determination of the limit switch group 38. RAM 46 has storage areas 46*a* to 46*g* onto which data is written during execution of the program (see FIG. 5).

To the control device 48 are further connected a sewing machine motor 50 driving the needle 12 and the shuttle 14, a start/stop switch 52 operated to start and stop the sewing machine motor, LCD 54 serving as an informing unit for displaying various messages and figures indicative of a sewing mode, and a transparent touch panel 56 serving as a selector disposed on a front face of LCD, as shown in FIG. 2. When the user operates the transparent touch panel 56 corresponding to the displayed contents of LCD 54, set values of thread tension, of feed amount, and sewing speed and sewing mode and embroidery pattern can be selected.

An embroidery unit 60 in which cloth is moved using an embroidery frame 58 is detachably attached to the sewing machine 10. In the embroidery unit 60, the embroidery frame 58 is moved in the right-and-left direction and back and forth by an X-axis pulse motor 62 and Y-axis pulse motor 64. The control device 64 controls the pulse motors 62 and 64 according to the selected embroidery pattern.

The control device 48 is connected via drive circuits (not shown) to the respective motors to disallow drive of all or individual motors, if occasion arises. Furthermore, the sewing machine 10 includes an embroidery unit detector 66 serving as a detector for detecting the embroidery frame 60 attached to the sewing machine 10. The embroidery unit detector 66 is connected to the control device 48.

The thread cassette 24 includes one used in a normal stitch mode in which cloth is moved by the feed dog 16 and one used in an embroidering mode in which cloth is moved by the embroidery frame 58 of the embroidery unit 60. There is a large number of types of the needle thread 20 wound on the thread spool 34 accommodated in the thread cassette 24 with respect to the material (raw material and thickness), length and color. In particular, in order that delicate differences in color may be realized in embroidery patterns, the needle thread 20 for the embroidering has a large number of colors. For example, regarding the pink color, the needle thread 20 has pink, deep pink, salmon pink, rose colors. Furthermore, each of these colors includes a dark color, so that the number of the colors is doubled. Thus, the colors of the needle thread are discriminated on the basis of delicate color differences, and a large number of thread cassettes 24 with the determination portions 40 (that is, depressions A' to L') corresponding to the respective discriminated colors.

Figure 7:
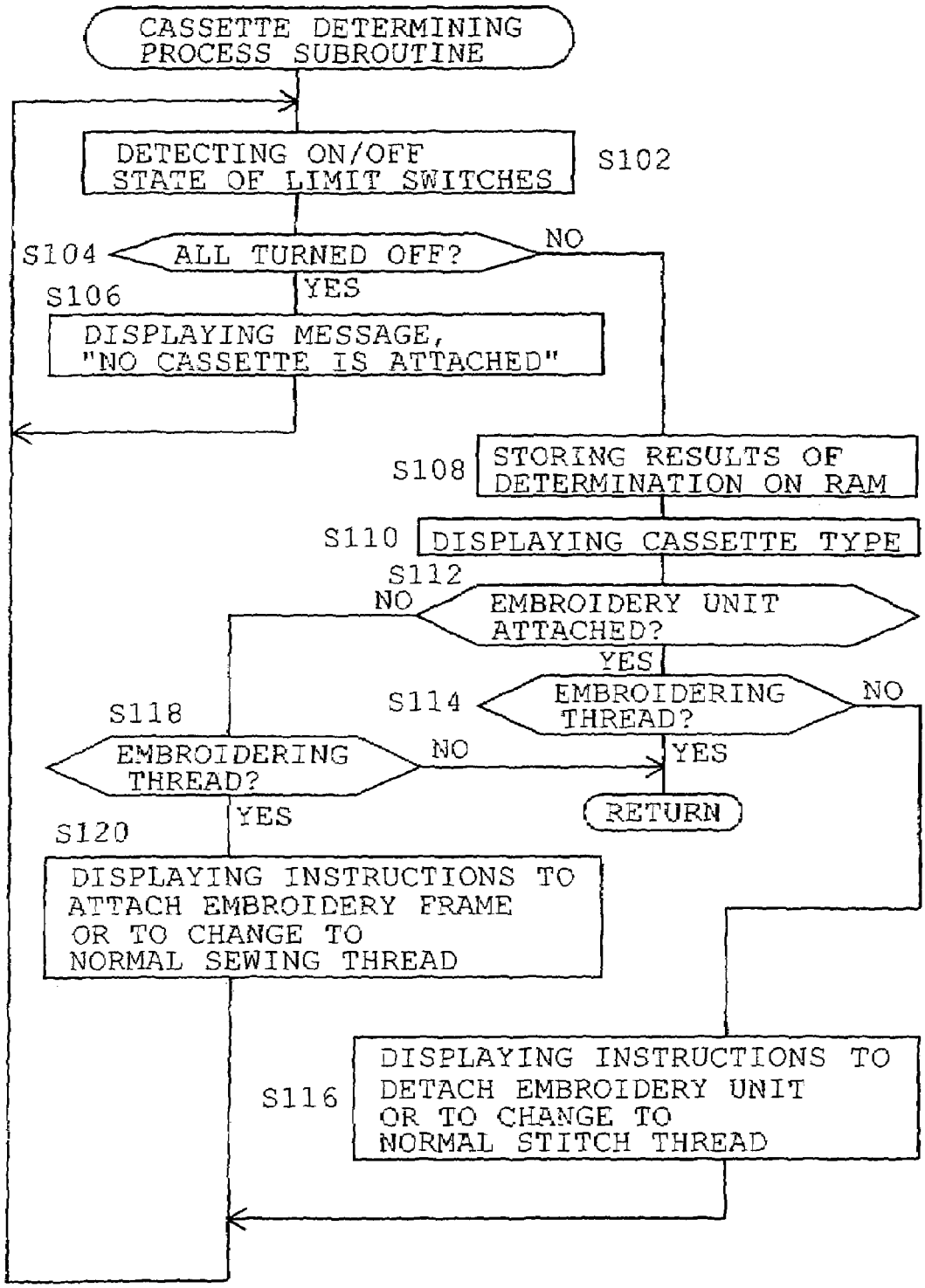
FIG. 7 is a flowchart showing a subroutine of a cassette determining process.
Figure 8:
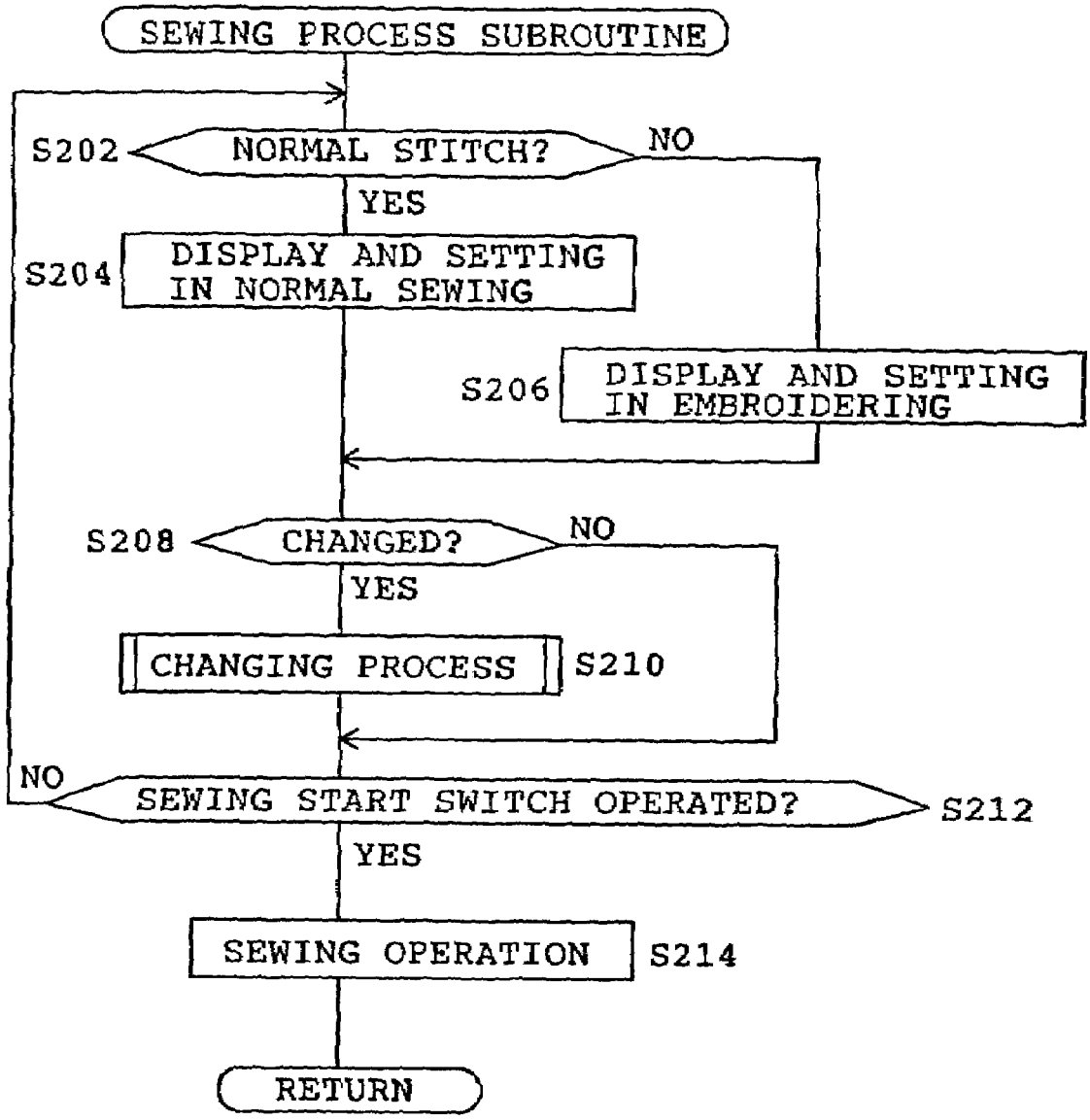
FIG. 8 is a flowchart showing a subroutine of a sewing process.
Figure 9:
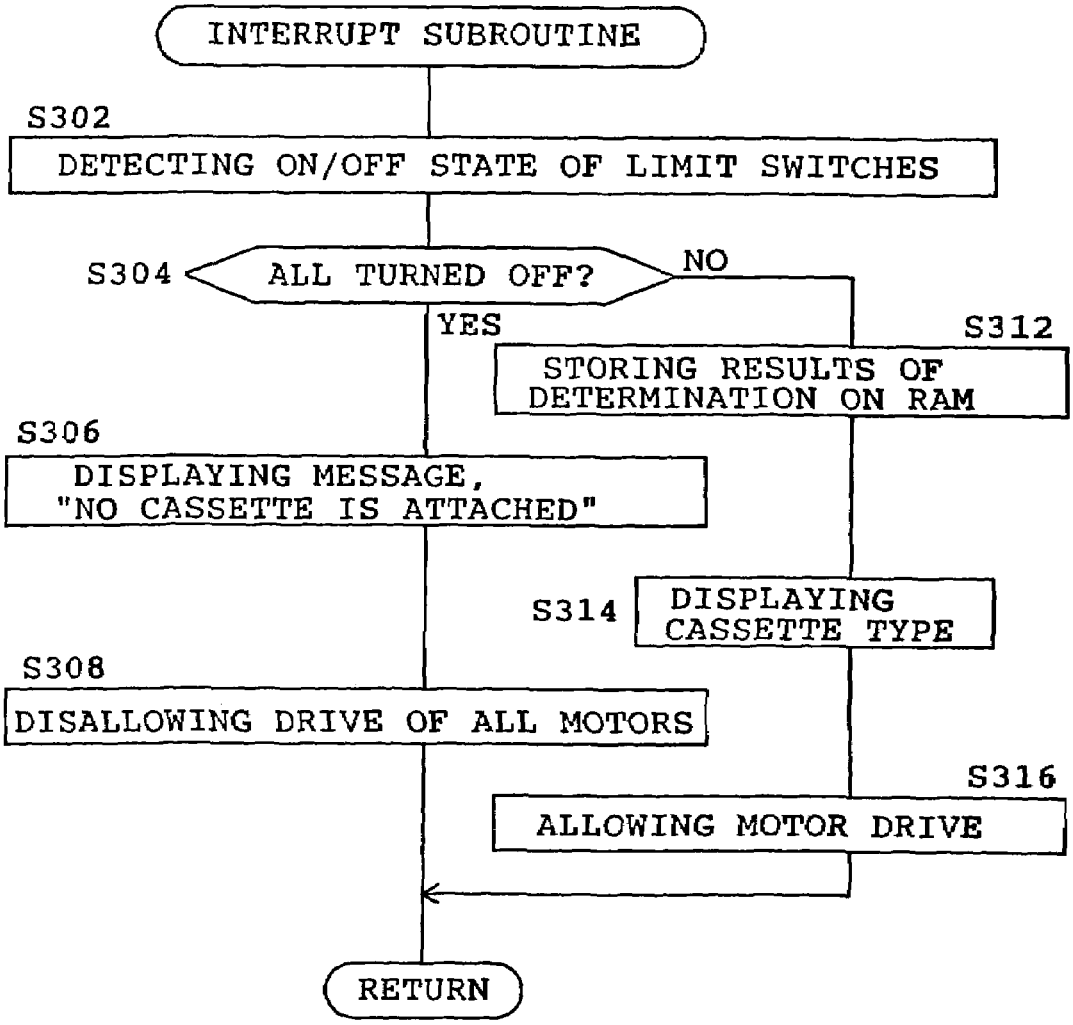
FIG. 9 is a flowchart showing a subroutine of an interrupt process.

The sewing operation executed by the sewing machine 10 will now be described with reference to FIGS. 6 to 9. When the sewing machine 10 is connected to a power supply, the control device 48 carries out a cassette determining process (step S100) and a sewing process (step S200) in turn as shown in FIGS. 7 and 8 respectively. The control device 48 further executes an interrupt subroutine as shown in FIG. 9.

In the cassette determining process, the control device 48 firstly determines the on/off state of each of the limit switches A to L of the limit switch group 38 (step S102). When all the limit switches A to L are in the off state (YES at step S104), the control device 48 determines that the thread cassette 24 has not been attached to the cassette mount 26. The control device 48 then controls the LCD 54 to display a message urging the user to insert the thread cassette 24 (step S106). The control device 48 is on standby until the thread cassette 24 is attached to the cassette mount 26 (steps S102 to S106).

All the limit switches A to L are in the off state before the thread cassette 24 is attached to the cassette mount 26. When the thread cassette 24 with the needle thread 20 being drawn out and extended along the guide groove as described above is inserted into the cassette mount 26 from above, at least one of the limit switches A to L is depressed by the face of the determination portion 40. The control device 48 determines one or more limit switches in the on state and the other limit switches in the off state. Furthermore, the control device 48 determines the type of the thread cassette 24, based on data tables as shown in FIGS. 10 to 15. In the data tables of FIGS. 10 to 15, numeral "1" designates the on state of each limit switch, whereas "0" designates the off state of each limit switch.

The control device 48 detects the thread cassette 24 having been attached to the cassette mount 26 (NO at step S104) when any one or more of the limit switches A to L have been turned to the on state. Thus, no dedicated sensor needs to be provided in order to detect the thread cassette 24 attached to the cassette mount 26 since the limit switch group 38 provided for determining the type of the thread cassette 24 is used also for detection of the attachment of the thread cassette 24. Consequently, the construction of the sewing machine 10 can be simplified.

The control device 48 stores data of the determination results regarding the limit switch group 38 at a predetermined storage area 46*a* (see FIG. 5) of RAM 46 (step S108). The data of the determination results is indicative of the type of the thread cassette 24 or the needle thread 20 held in the thread cassette. Thus, since the type of the thread cassette 24 is automatically determined, the user need not confirm the needle thread 20 held in the thread cassette 24 every time the thread cassette is attached to the cassette mount 26. Consequently, the convenience of the sewing machine 10 can be improved.

Figure 16:
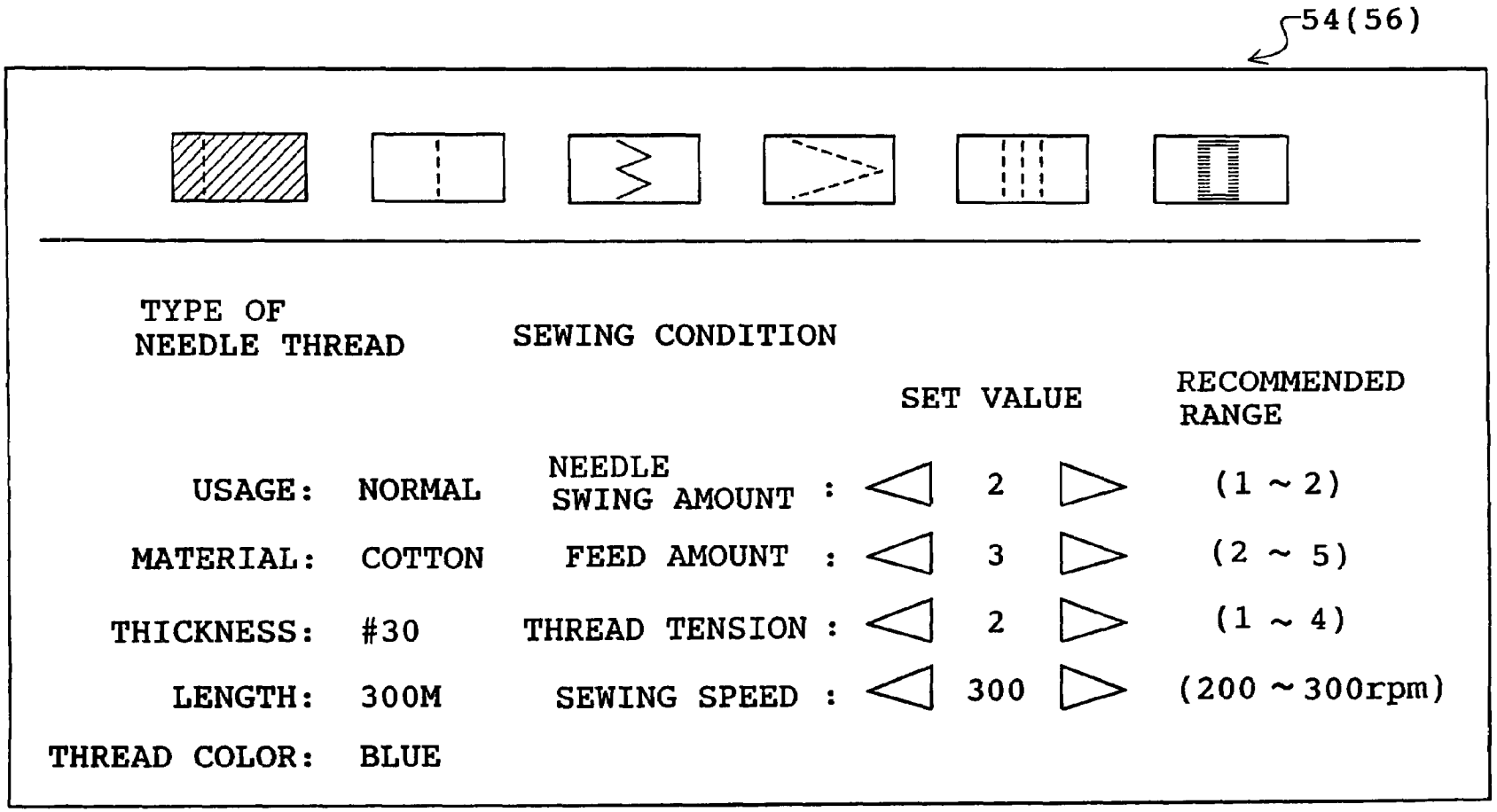
FIG. 16 shows the contents displayed on LCD in the normal stitch.

Successively, the control device 48 controls the LCD 54 so that a message about the type of the attached thread cassette 24 or needle thread 20 is displayed on the basis of the data of the determination results (step S110). For example, as shown in FIG. 16, the thread cassette 24 is for the normal stitch, the material of the needle thread 20 is cotton, the needle thread 20 has a thickness of #30 and a length of 300 m, and the thread color is blue.

Based on the data table and the status of the limit switch A as shown in FIG. 10, the control device 48 can determine which the thread cassette 24 is, for the normal stitch or for the embroidering. When the thread cassette 24 is for the normal stitch, the control device 48 determines the material of the needle thread 20, based on the data table and the status of the limit switches B to D as shown in FIG. 11. Furthermore, the control device 48 determines the thickness of the needle thread 20, based on the data table and the status of the limit switches E to G as shown in FIG. 12. The control device 48 further determines the length of the needle thread 20 wound on the thread spool 34, based on the data table and the status of the limit switch H as shown in FIG. 13. Additionally, the control device 48 determines the color of the needle thread 20, based on data table and the status of the limit switches I to L as shown in FIG. 14.

On the other hand, when the attached thread cassette 24 is for the embroidering, the control device 48 determines the color of the needle thread 20, based on data table and the status of the limit switches B to L as shown in FIG. 15. A thread color code as shown in FIG. 15 is used when the user purchases a needle thread 20 of a desired color. Since the delicate differences in color are required in the embroidering as described above, even the limit switches B to H, which are used to determine the material and length of the needle thread 20 in the normal stitch, are also used to determine the color of the needle thread. Thus, a large number of colors can be determined using a limited number of limit switches and accordingly, the construction of the sewing machine 10 can be simplified. Furthermore, the determination portion 40 provided on the thread cassette 24 has a small area and accordingly, the size of the thread cassette 20 can be reduced.

The control device 48 then stores data of the results of detection by the embroidery unit detector 66 at a predetermined storage area 46*b* (see FIG. 5) of RAM 46. The embroidery unit detector 66 is provided for detecting the embroidery unit 60 attached to the sewing machine 10.

Based on the data of detection results, the control device 48 determines compatibility between the previously determined type of the thread cassette 24 and the embroidery unit 60. More specifically, the control device 48 detects the embroidery unit 60 having been attached to the sewing machine 10 (YES at step S112) and determines that the attached thread cassette 24 is not for the embroidering (NO at step S114). Consequently, the control device 48 determines that the embroidery unit 60 is incompatible with the type of the thread cassette 24. The thread cassette 24 for the embroidering should be attached to the cassette mount 26 (the needle thread 20 for the embroidering) when the embroidery unit 60 is attached to the sewing machine 1.

Thus, when the embroidery unit 60 is attached to the sewing machine 10 and the thread cassette 24 for the normal stitch is attached to the cassette mount 26, the control device 48 controls the LCD 54 so that a message indicating that the embroidery unit 60 should be detached from the sewing machine or the thread cassette 24 should be changed to one for the embroidering (step S116).

Furthermore, when detecting the embroidery unit 60 not being attached to the sewing machine 10 (NO at step S112) and determining that the attached thread cassette 24 is for the embroidering (YES at step S118), the control device 48 determines that the embroidery unit 60 is incompatible with the type of the thread cassette 24. When the embroidery unit 60 is not attached to the sewing machine 10, the thread cassette 24 or needle thread 20 for the normal stitch should be attached to the cassette mount 26. Thus, when the embroidery unit 60 is not attached to the sewing machine 10 and the attached thread cassette 24 is for the embroidering, the control device 48 controls the LCD 54 so that a message indicating that the embroidery unit 60 should be attached to the sewing machine or the thread cassette 24 should be changed to one for the normal stitch (step S120).

When the attachment of the embroidery unit 60 is incompatible with the type of the thread cassette 24, the control device 48 is on standby until the incompatibility is resolved by the user. When the incompatibility has been resolved, the control device 48 carries out the sewing process (S200) for the sewing operation using the needle thread 20 of the attached thread cassette 24. Furthermore, when the thread cassette 24 is attached to the cassette mount 26, the needle thread 20 of the attached thread cassette is caused to be placed between the thread tension discs of the thread tensioning mechanism 22 so that the thread tension of the needle thread 20 can be changed.

In the sewing process (step S200) as shown in FIG. 8, the control device 48 controls the LCD 54 so that a plurality of previously determined sewing conditions are displayed on the LCD on the basis of attachment of the embroidery unit 60 and the type of the thread cassette 24. Furthermore, the control device 48 automatically selects and sets initial values of necessary one or more of the sewing conditions including an amount of needle swing, amount of feed, thread tension, sewing mode, sewing speed and the like. The control device 48 controls the mechanisms so that the set initial values become suitable for the respective mechanisms (steps S202 to S206). More specifically, when not detecting the embroidery unit attached to the sewing machine and determining that the thread cassette 24 attached to the cassette mount 26 is for the normal stitch (YES at step S202), the control device 48 carries out the following display and setting for the normal stitch (step S204).

The control device 48 controls the LCD 54 so that figures representative of sewing modes using the feed dog 16 as information about the sewing in which cloth is moved by the feed dog, as shown in FIG. 16. In this case, the LCD 54 does not display a sewing mode expected to be unsuitable for the material of the needle thread 20 of the attached thread cassette 24. For example, a sewing mode increasing a load against the needle thread 20 is not displayed when the material of the needle thread 20 is easy to cut and has a large thickness.

In the case of the normal stitch, the control device 48 controls the LCD 54 so that recommended ranges of suitable set values are displayed regarding a needle swing amount of the needle 21, a feed amount of the feed dog 16 and a thread tension by the thread tensioning mechanism during the sewing. The control device 48 further controls the LCD 54 so that an automatically set value of thread tension is displayed. The set value is determined so as to be optimum within the recommended range. In this case, the control device 48 automatically controls the needle swing pulse motor 28, feed amount pulse motor 30 and the thread tension pulse motor 32 so that the needle swing amount, feed amount and a thread tension become suitable for the above-described set condition. Furthermore, based on data of determination of the attached thread cassette 24, the control device 48 automatically sets a sewing speed which is expected to be a maximum speed (a rotational speed of the sewing machine motor 50) suitable for the needle thread 20 of the thread cassette 24 and controls the LCD 54 so that a settable speed range is displayed. The control device 48 stores, at storage areas 46*c* to 46*g* (see FIG. 5), data of the sewing conditions including the set sewing mode, needle swing amount, feed amount, thread tension and sewing speed.

For example, when one type of the thread cassette 24 for normal stitch is attached, the control device 48 sets the needle swing amount at the smallest of three degrees, the feed amount at the middle or third of five degrees, the thread tension at the second lowest of nine degrees, and the sewing speed at the lowest speed of three degrees and displays the set values. When another type of the thread cassette 24 for normal stitch is attracted, the control device 48 sets the needle swing amount at the largest of the three degrees, the feed amount at the shortest of the five degrees, the thread tension at the middle of the nine degrees, and the sewing speed at the highest of the three degrees and displays the set values.

When the user changes the sewing conditions, the sewing conditions are affected as when the type of the thread cassette 24 is changed. The control device 48 automatically changes the displayed and set contents of the sewing conditions as follows when the sewing mode is changed even though the same type of thread cassette 24 is used. For example, when one type of thread cassette 24 for the normal stitch is attached and one sewing mode is selected, the control device 48 sets the needle swing amount at the largest of three degrees, the feed amount at the shortest of five degrees, the thread tension at the middle or fifth of nine degrees, and the sewing speed at highest of three degrees, displaying the set values. When another sewing mode is selected without change in the thread cassette 24, the control device 48 sets the needle swing amount at the middle or second of the three degrees, the feed amount at the middle or third of the five degrees, the thread tension at the second of the nine degrees, and the sewing speed at the middle or second of the three degrees, displaying the set values.

Furthermore, when detecting the embroidery frame 60 having been attached to the sewing machine 10 and determines that the thread cassette 24 attached to the cassette mount 26 is for the embroidering (NO at step S202), the control device 48 carries out the following setting and displaying for the embroidering (step S206).

Figure 17:
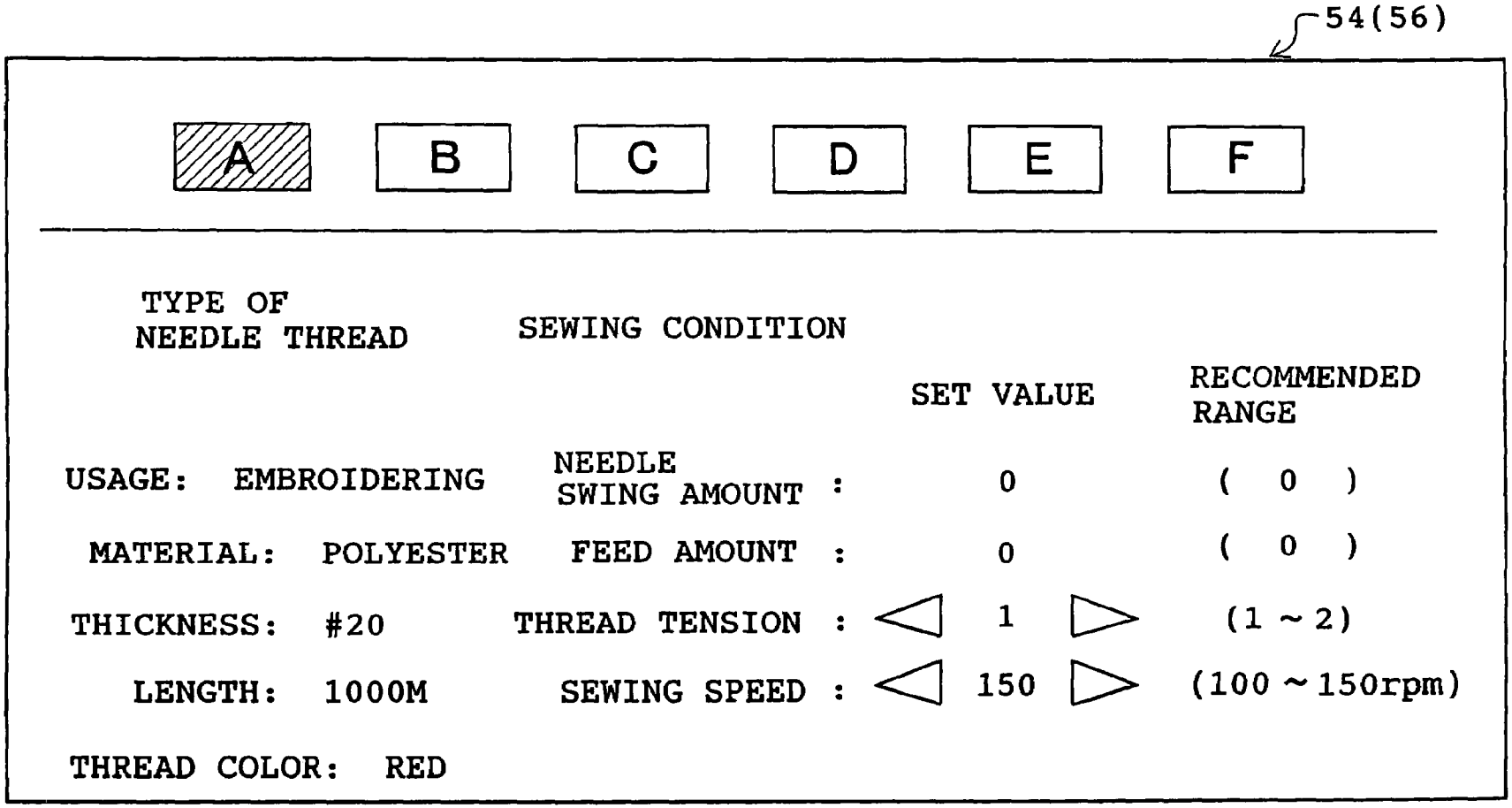
FIG. 17 shows the contents displayed on LCD in the embroidering.

The control device 48 controls the LCD 54 so that embroidery patterns sewn using the embroidery frame 58 as information about the embroidering in which cloth is moved by the embroidery frame, as shown in FIG. 17. Since the needle swing is not carried out in the embroidering, the control device 48 sets the needle swing amount at zero so that the needle swing is stopped. Furthermore, since the feed dog 16 is not used for moving the cloth, the control device 48 sets the feed amount at zero so that the movement of the feed dog 18 is stopped.

In the embroidering, too, the control device 48 controls the LCD 54 so that a recommended range of suitable set value is displayed regarding the thread tension by the thread tensioning mechanism 22. The control device 48 automatically sets the thread tension at an optimum value in the recommended range and controls the LCD 54 so that a set value is displayed. Information (usage and the like) about the type of the thread cassette 24 (needle thread 20) is also displayed on the LCD 54 together with the set value of thread tension. In this case, too, the control device 48 controls the thread tension pulse motor 32 so that the thread tension becomes equal to the initially set value. Furthermore, the control device 48 automatically sets a maximum speed, based on the data of determination results regarding the attached thread cassette 24, controlling the LCD 54 so that the maximum speed is displayed. The control device 48 stores, at the predetermined storage areas 46*c* to 46*g* of RAM 46 (see FIG. 5), data of the sewing conditions including the selected embroidery pattern, set needle swing amount, feed amount, thread tension, and sewing speed. In the embroidering, too, when the thread cassette 24 is changed, the control device 48 carries out the setting and displaying regarding the thread tension and sewing speed on the basis of the type of the thread cassette 24.

The control device 48 then determines whether the automatically determined sewing conditions have been changed via the transparent touch panel 56 by the user. When the sewing conditions have been changed, the control device 48 thereafter carries out processing for the corresponding displaying, setting and renewal of stored contents (steps S208 to S210).

In the normal stitch, all of the needle swing amount, feed amount, thread tension, sewing speed and sewing mode can be changed by the user. In the embroidering, however, only the thread tension and sewing speed can be changed by the user. Furthermore, the displayed sewing mode and embroidery pattern both automatically selected at the initial stage are inverted on the LCD 54 (slashed parts in FIGS. 16 and 17) so as to be distinguished from the other unselected sewing modes and embroidery patterns. Embroidery patterns of characters "A" to "F" are displayed on the screen as shown in FIG. 17.

Upon operation of the start/stop switch 52 for start of sewing (YES at step S212), the control device 48 controls the sewing machine motor 50 and the like so that the sewing operation is carried out according to the sewing conditions set regarding the selected sewing mode or embroidery pattern (step S214). In the normal stitch, the control device 48 automatically controls an amount of movement of cloth by the feed dog 16 according to sewing data of selected sewing mode. Furthermore, in the embroidering, the control device 48 automatically controls an amount of movement of cloth by the embroidery frame 58 according to sewing data of selected embroidery pattern.

The control device 48 executes the following interrupt routine (see FIG. 9) at predetermined intervals after the cassette determining process (step S100) has been completed. The interrupt routine is executed even during the sewing process (step S200). The interrupt routine may be allowed in the cassette determining process (step S100).

The control device 48 determines the status of the limit switch group 38 (step S302). When detecting all the limit switches A to L in the off state (YES at step S304), the control device 48 automatically disallows drive of all the motors, determining that the thread cassette 24 has not been attached to the cassette mount 26 (step S308). The thread cassette 24 is attached to the cassette mount 20 after the drive of all the motors has been disallowed. When detecting any one or more of the limit switches A to L turned to the on state (NO at step S304), the control device 48 stores data of determination results at the predetermined storage area 46*a*, controls the LCD 54 so that the type of the attached thread cassette 24 is displayed, and releases all the motors from disallowance of drive (steps S312 to S316).

According to the foregoing embodiment, the type of the thread cassette 24 is determined and the sewing mechanism 17 is automatically controlled by the control device 48. Consequently, the convenience of the sewing machine can be improved and accordingly, the user can carry out a desired sewing without troublesome setting of the sewing conditions.

A part (the limit switches B to L) of the limit switches A to L constituting the limit switch group 38 carry out both determination other than thread color of the thread cassette 24 for the normal stitch and determination of the thread color of the thread cassette 24 for the embroidering. Consequently, the construction of the sewing machine 10 can be simplified. Furthermore, use of the limit switch group 38 can perform both determination of the thread cassette 24 and detection of the thread cassette. Since no detector is required for detecting presence or absence of the thread cassette 24, the construction of the sewing machine 10 can further be simplified.

The control device 48 automatically disallows drive of all the motors when determining that the thread cassette 24 is not attached to the cassette mount 26. Consequently, an inadvertent start of the sewing mechanism 17 which cannot be expected by the user can be prevented.

When the thread cassette 24 has been attached to the cassette mount 26, information about the type of the thread cassette 24 (information about the normal stitch or embroidering) is automatically informed of. Consequently, the user can carry out the sewing operation according to the informed contents and accordingly, the convenience of the sewing machine can be improved.

Figure 1A:
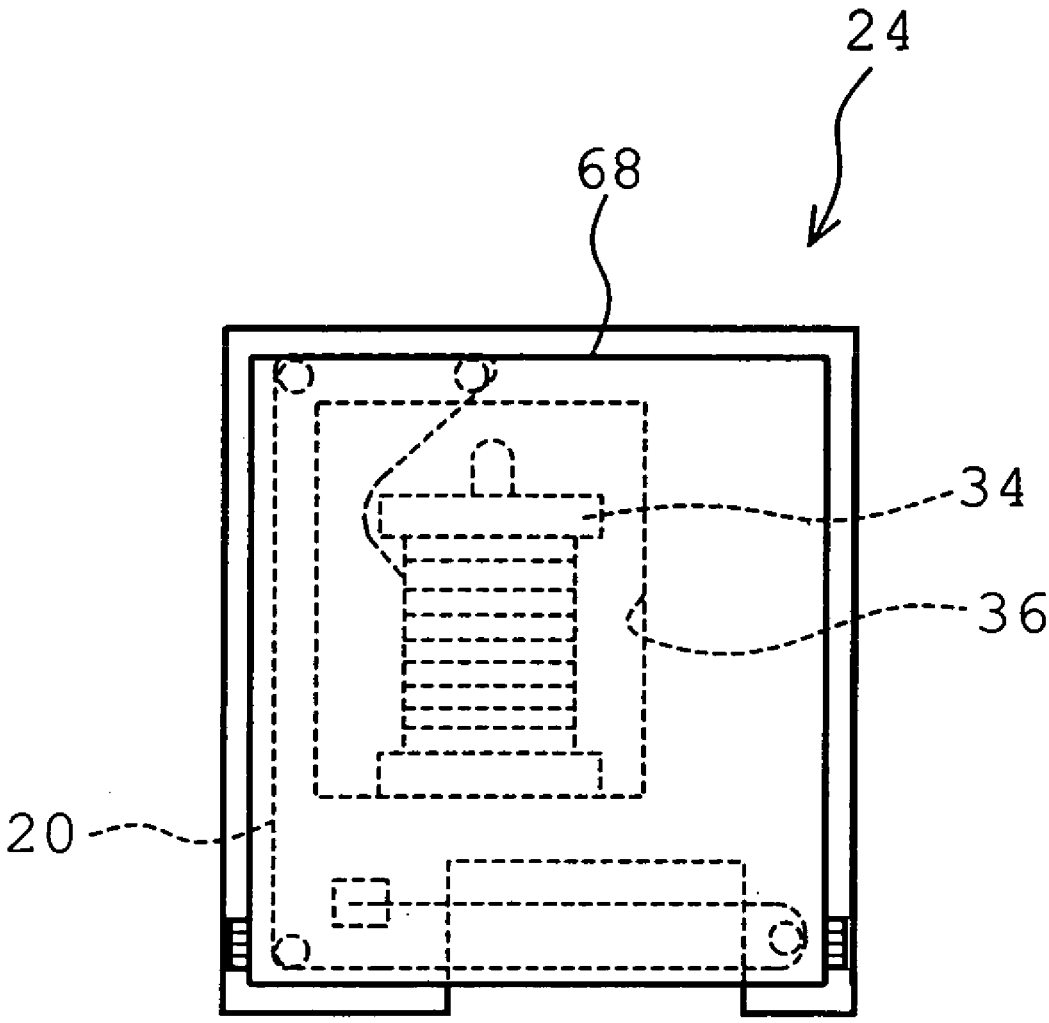
FIG. 1A is a front view of the thread cassette which is provided with an opaque lid for closing an opening of the cassette.

The above-described embodiment may be modified as follows. The needle thread 20 accommodated in the thread cassette 24 may or may not be wound on a core member such as the thread spool 34. The thread cassette 24 may or may not be provided with the walls surrounding the thread spool 34 only if the thread spool 34 is accommodated therein. The walls surrounding the thread spool 34 may be transparent or translucent. The thread cassette 24 may be provided with a lid 68 (as shown in FIG. 1A) closing the opening thereof. The lid 68 may be opened so that the thread spool 34 is inserted into and taken out of the thread cassette 24.

The control device 48 may control at least one of a feed amount of the feed amount pulse motor 30 or a needle swing amount of the needle swinging pulse motor 28 according to the identified type of the thread cassette 24. Furthermore, a switching mechanism comprising a pulse motor may be provided for switching the feed dog 16 between an operative state for the sewing and a shunted state where the feed dog is shunted below the needle plate. The control device 48 may control the switching mechanism so that the feed dog is turned to the operative state in the normal stitch and to the shunted state in the embroidering.

In the foregoing embodiment, when the embroidery unit 60 is incompatible with the usage (the normal stitch or embroidering) of the thread cassette 24, the control device 48 determines that this is an erroneous state. However, the programs may be arranged so that the type of the thread cassette 24 has priority, instead. For example, the programs may be arranged so that the control device 48 carries out display and setting for the normal stitch when the thread cassette 24 for the normal stitch is attached to the cassette mount even though the embroidery unit 60 is attached to the sewing machine. Furthermore, the feed dog 16 may be turned to the operative state in a sewing machine provided with the aforesaid switching mechanism.

In the foregoing embodiment, the control device 48 determines the sewing conditions, based on both the results of determination regarding the thread cassette 24 attached to the cassette mount 26 and the selected sewing mode. However, the control device may determine the sewing conditions on the basis of either the determination results or the selected sewing mode, instead.

In the foregoing embodiment, the control device 48 disallows drive of all the motors thereby to prohibit starting of the sewing mechanism 17. However, the control device 48 may disallows drive of at least a part of the motors or more specifically, only the sewing machine motor 50, instead. Furthermore, the control device 48 automatically carries out display and setting of the sewing conditions in the foregoing embodiment. However, the control device 48 may carries out either display or setting, instead.

The control device 48 may control the LCD 54 so that the needle swing amount and feed amount are not displayed when each of the amounts is zero in the embroidering. Furthermore, when the type of the thread cassette 24 is incompatible with the embroidery unit 60, the control device 48 may control the LCD 54 so that information about what incompatibility is occurring is displayed as well as working instructions for the user. Additionally, only the aforesaid information may be displayed, instead. Such information includes, for example, the fact that the thread cassette 24 for the normal stitch is attached to the cassette mount 26 and the fact that the embroidery unit 60 is attached to the sewing machine 10.

The determining unit should not be limited to the limit switch group 38. The determining unit may be electrical, mechanical or optical. The number of limit switches constituting the limit switch group 38 should not be limited to "12." The number may be increased or decreased according to an amount of information determined.

Although the LCD 54 is used as the informing unit in the foregoing embodiment, another display unit such as CRT or an audio output unit may be used, instead.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A sewing apparatus comprising:

a sewing mechanism in which a needle thread is used;

a cassette mount to which a thread cassette, while in a closed state, holding the needle thread used in the sewing mechanism is detachably attached;

a determining unit determining a type of the thread cassette attached to the cassette mount; and a control device controlling the sewing mechanism according to the type of the thread cassette determined by the determining unit.

2. A sewing apparatus according to claim 1, further comprising an adjuster adjusting a thread tension of the needle thread supplied from the thread cassette attached to the cassette mount, wherein the control device controls the adjuster according to the type of the thread cassette determined by the determining unit.

3. A sewing apparatus according to claim 1, wherein the sewing mechanism includes a feeder for feeding a piece of cloth to be sewn and a needle swinging unit which swings a sewing needle horizontally, wherein the control device controls at least one of an amount of feed by the feeder and an amount of swing by the needle swinging unit according to the type of the thread cassette determined by the determining unit.

4. A sewing apparatus according to claim 1, further comprising a selector selecting one of a plurality of types of sewing modes performed by the sewing mechanism, wherein the control device controls the sewing mechanism according to the type of sewing mode selected by the selector and the type of thread cassette determined by the determining unit.

5. A sewing apparatus according to claim 1, wherein the thread cassette includes a first cassette used in a normal sewing in which a cloth is moved by a feed dog and a second cassette used in an embroidering in which an embroidery frame is used to move a cloth, wherein the determining unit determines whether the thread cassette attached to the cassette mount is, the first cassette or the second cassette, and the control device controls the sewing mechanism so that the sewing mechanism sews the cloth moved by the feed dog, when the determining unit determines that the thread cassette is the first cassette and so that the sewing mechanism sews the cloth moved by the embroidery frame, when the determining unit determines that the thread cassette is the second cassette.

6. A sewing apparatus according to claim 5, wherein the control device controls an amount of movement of the cloth moved by the feed dog when the sewing mechanism sews the cloth moved by the feed dog, and the control device controls an amount of movement of the cloth by the embroidery frame when the sewing mechanism sews the cloth moved by the embroidery frame.

7. A sewing apparatus according to claim 1, wherein the thread cassette includes a first cassette used in a normal sewing in which a cloth is moved by a feed dog and a second cassette used in an embroidering in which an embroidery frame is used to move a cloth, wherein the determining unit has a plurality of determining members including at least a part used to determine whether the thread cassette attached to the cassette mount is, the first cassette or the second cassette, said plurality of the determining members including the other part further including at least a part used to determine at least one of a material of the thread and a length of the thread regarding the thread cassette for the normal sewing and further used to determine a thread color regarding the thread cassette for the embroidering.

8. A sewing apparatus according to claim 1, wherein the determining unit detects the thread cassette attached to the cassette mount.

9. A sewing apparatus according to claim 8, wherein the control device disallows the sewing mechanism to start when the thread cassette having been attached to the cassette mount is undetected.

10. A sewing apparatus comprising:

a sewing mechanism in which a thread is used;

an informing unit supplying information about a sewing work to a user;

a cassette mount to which a thread cassette holding the thread used in the sewing mechanism is detachably attached;

a determining unit determining a type of the thread cassette attached to the cassette mount; and a control device controlling the informing unit according to the type of the thread cassette determined by the determining unit.

11. A sewing apparatus according to claim 10, wherein the thread cassette includes a first cassette used in a normal sewing in which a cloth is moved by a feed dog and a second cassette used in an embroidering in which an embroidery frame is used to move a cloth, wherein the determining unit determines whether the thread cassette attached to the cassette mount is, the first cassette or the second cassette, and the control device controls the informing unit so that the informing unit informs of sewing in which the cloth is moved by the feed dog, when the thread cassette attached to the cassette mount is the first cassette, the control device further controlling the informing unit so that the informing unit informs of sewing in which the cloth is moved by the embroidery frame, when the thread cassette attached to the cassette mount is the second cassette.

12. A sewing apparatus according to claim 11, wherein informing of sewing in which the cloth is moved by the feed dog includes informing of a sewing manner using the feed dog, and informing of sewing in which the cloth is moved by the embroidery frame includes informing of an embroidery pattern formed using the embroidery frame.

13. A sewing apparatus according to claim 10, further comprising a detector detecting an embroidering unit detachably attached to the sewing apparatus, wherein the thread cassette includes a first cassette used in a normal sewing in which a cloth is moved by a feed dog and a second cassette used in an embroidering in which an embroidery frame is used to move a cloth, and the control device controls the informing unit so that the informing unit carries out a predetermined informing operation regarding replacement of the thread cassette or attachment and detachment of the embroidering unit when the first cassette is attached to the cassette mount and the embroidering unit is not attached to the sewing apparatus.

14. A sewing apparatus according to claim 10, further comprising a detector detecting an embroidering unit detachably attached to the sewing apparatus, wherein the thread cassette includes a first cassette used in a normal sewing in which a cloth is moved by a feed dog and a second cassette used in an embroidering in which an embroidery frame is used to move a cloth, and the control device controls the informing unit so that the informing unit carries out a predetermined informing operation regarding replacement of the thread cassette or attachment and detachment of the embroidering unit when the first thread cassette is attached to the cassette mount and the embroidering unit is attached to the sewing apparatus.

15. A thread cassette, while in a closed state, holding a needle thread supplied to a sewing mechanism of a sewing apparatus, comprising a determination portion provided so as to be opposed to a detecting portion of the sewing mechanism when attached to the sewing apparatus, the determination portion being designed so that a correspondence between the determination portion and the detecting portion is fulfilled according to a type of a needle thread held by the thread cassette, wherein a determining unit provided in the sewing mechanism is capable of determining a type of a needle thread based on the fulfilled correspondence.

16. A control program for a sewing apparatus including a sewing mechanism performing a sewing operation, a cassette mount to which a thread cassette, while in a closed state, holding a needle thread used in the sewing mechanism is detachably attached, and a determining unit determining a type of the thread cassette attached to the cassette mount, said control program operating a computer controlling the sewing apparatus as a control device controlling the sewing mechanism according to the type of the thread cassette determined by the determining unit.

* * * * *